United States Patent [19]

Weir

[11] Patent Number: 4,498,805

[45] Date of Patent: Feb. 12, 1985

[54] BREAKWATER MODULE AND MEANS FOR PROTECTING A SHORELINE THEREWITH

[76] Inventor: Frederick E. Weir, c/o Epernay Properties, Inc., R.R. #3, Spring Green, Wis. 53588

[21] Appl. No.: 556,004

[22] Filed: Nov. 29, 1983

[51] Int. Cl.[3] ..... E02B 3/06

[52] U.S. Cl. ..... 405/31; 405/35

[58] Field of Search ..... 405/15, 21, 25, 30, 405/31, 34, 35

[56] References Cited

U.S. PATENT DOCUMENTS

| | | | |
|---|---|---|---|
| 2,080,045 | 5/1937 | Hornsby | 405/31 |
| 3,490,239 | 1/1970 | Vincent | 405/31 |
| 3,538,710 | 11/1970 | Tourmen | 405/31 |
| 3,913,333 | 10/1975 | Hubbard | 405/31 |
| 4,407,608 | 10/1983 | Hubbard | 405/31 |

FOREIGN PATENT DOCUMENTS

| | | | |
|---|---|---|---|
| 684824 | 3/1965 | Italy | 405/31 |
| 669001 | 6/1979 | U.S.S.R. | 405/31 |
| 791827 | 1/1980 | U.S.S.R. | 405/34 |

*Primary Examiner*—David H. Corbin

*Attorney, Agent, or Firm*—McCaleb, Lucas & Brugman

[57] ABSTRACT

A concrete breakwater module for use with like modules positioned side-by-side in a line along or offshore from a beach or bluff for preventing erosion due to wave action and for reversing previous erosion. Each module has a single, large, upwardly concave, wave-energy-absorbing trough of partly cylindrical and partly flat-bottomed contour adjacent rear and front upright walls respectively located at opposite ends of a bottom, base wall. The front wall has a sloping front end surface directing incoming waves and spray over the trough. The rear wall is substantially higher than the front wall to intercept waves and spray and re-direct them downwardly along a cylindrical surface and forwardly in the trough providing a rolling and swirling action of water which erupts at the front wall in a countercurrent manner against waves and spray overtopping the front wall. In one embodiment, one or more horizontal passageways extend through the rear wall, and have forwardly diminishing areas, to direct jet-like streams forwardly into the trough when water level on the shore side is relatively high. These streams augment the rolling action of water in the trough and enhance wave energy absorption. Sediment precipitates out of water when it flows rearwardly through these passageways. Embodiments are illustrated forming single and double breakwaters to protect a beach, along a sea wall to protect it from undermining, and along the toe of a bluff to protect it from slumping.

12 Claims, 9 Drawing Figures

28
22
20
25
26
24
30
30
28

36
52
26
54
48"
58
6"
56
56
36"
48
40
64
50
66
46
34
51
44
21"
32
42
84"
38
32
34

40
60
36
25
62
68
60
38
44
52
48
50
46
56
54

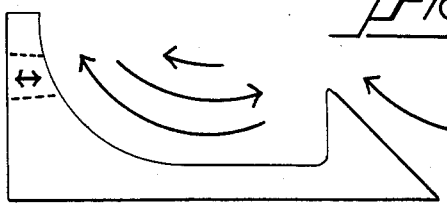
Fig. 4
Fig. 5
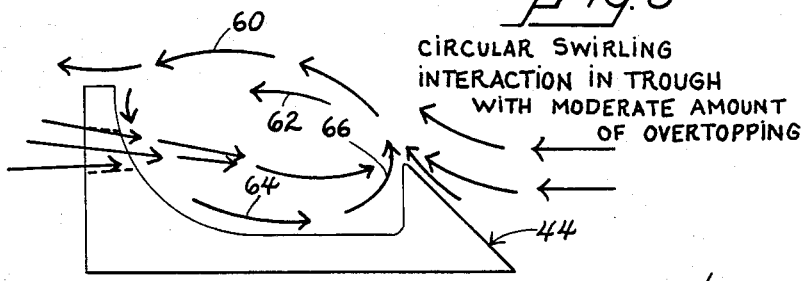
Fig. 6
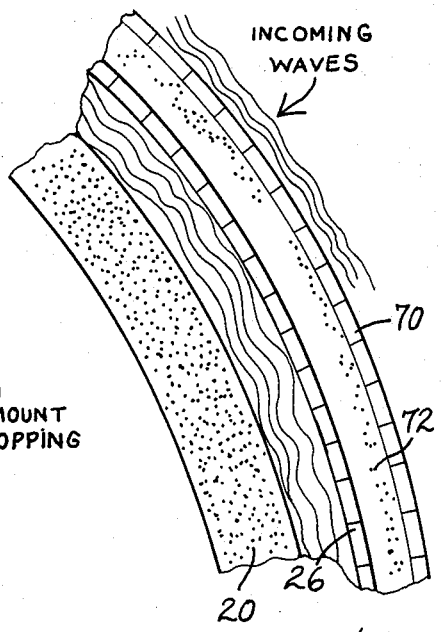
Fig. 9
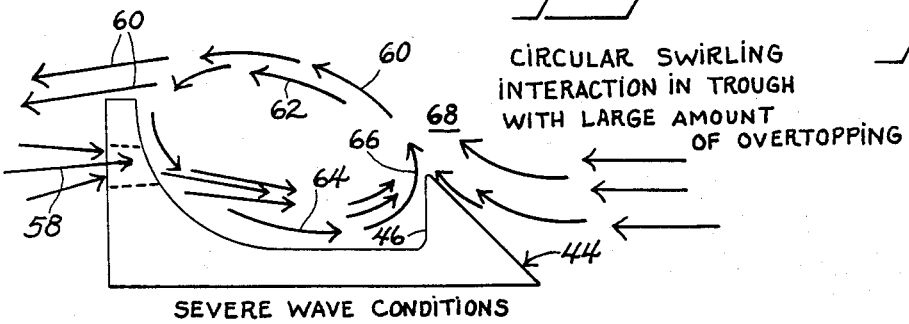
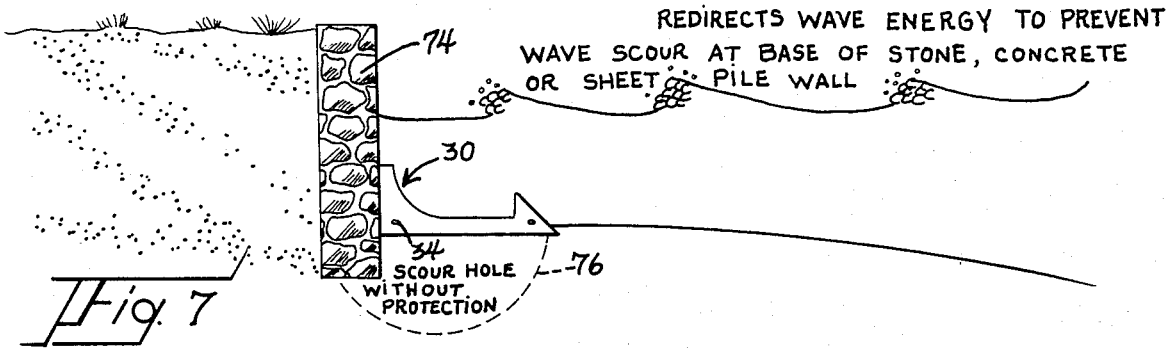
Fig. 7
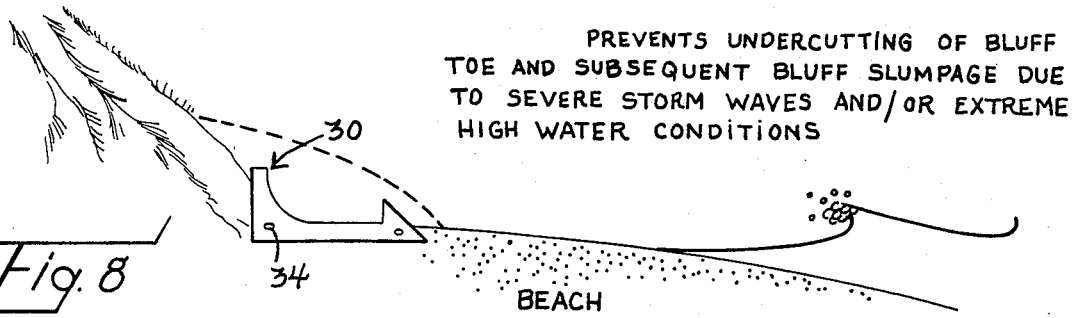
Fig. 8

BREAKWATER MODULE AND MEANS FOR PROTECTING A SHORELINE THEREWITH

BACKGROUND OF THE INVENTION

This invention relates generally to control of shoreline erosion by wave action, and particularly to durable, adaptable, and relatively low cost means for preventing erosion, and re-building beaches which have already been eroded.

Erosion of beaches is an old problem common to shoreline property everywhere. During storms, sand, gravel, dirt, clay and other sedimentary materials in the beaches, and in the banks and the bluffs behind the beaches, are washed away. Entire beaches disappear and buildings slide into the water when the bluffs and banks on which they are built are undermined. The problem feeds on itself. As a beach is lowered by wave action, erosion accelerates.

Undermining of bluffs and banks and sea walls is especially serious if buildings are supported on or near them. Among the factors which contribute to bluff and bank erosion are the following: natural weaknesses of some bluff materials as for example when they contain substantial percentages of clayey ingredients; ground water seeps and springs; periodically high water levels; artificially oversteepened slopes; loss of protective vegetation; capture and loss of littoral drift materials by man-made shore structures; and lack of natural shore protection (beaches) due to loss of sand and gravel.

Many conventional devices and techniques have been developed for protecting shorelines from erosion, but all have drawbacks and disadvantages. One involves making a sea wall at the shoreline, or an offshore breakwater, from massive blocks of stone or concrete, or timbers, which absorb wave energy by direct impact. If the mass is great enough and well enough anchored on a solid, deep foundation to withstand severe wave and ice conditions, these structures are generally effective. Other types are intended to channel waves into or through a series of openings or chambers in order to dissipate wave energy. These tend to be fragile and susceptible to damage and become ineffective when the openings and chambers become clogged with ice, timbers and debris and are subjected to freezing and thawing cycles. Both types are expensive and difficult to construct and maintain, and in some cases, while protecting the intended property, they create littoral currents or deflect the natural wave action to accelerate shoreline erosion on neighboring properties. Further, they are simply too expensive to be practical to protect the great bulk of beaches and shorelines which are steadily disappearing around the world.

Proposals for less expensive breakwaters made up of concrete modular units placed edge-to-edge in the water in a line parallel to the beach have been made and there are a few experimental installations of these. They have an advantage in that they can be placed rapidly by helicopter or barge or shore-based cranes at a cost which should be attractive to many property owners who otherwise could not justify the cost of conventional, massive sea walls and breakwaters.

One substantial limitation of these prior structures is that they are not really very effective in reversing the effects of erosion and re-building beaches once erosion has occurred, in spite of claims advanced for them.

SUMMARY OF THE INVENTION

It is a general object of the present invention to provide durable, adaptable, and relatively low-cost means for controlling shoreline erosion by reducing the force of waves, and facilitating deposition of water-borne sand particles and sediment to form a wider and higher beach, thereby re-building a beach and reversing beach front erosion which has already occurred.

Another object of the invention is to provide one or more breakwaters from a series of special configuration, identical modules placed in one or more lines offshore to reduce shoreline erosion by dissipating wave energy before it reaches the beach, and to deposit water-borne sand and silt on the landward side to compensate for previous erosion.

Another object is to provide a breakwater which dissipates wave energy by combining great weight and a wide base with a hydraulically dynamic design which causes the wave energy to work against itself; energy being transferred from the waves into the breakwater structure, and also by water-to-water interactions by which energy from an incoming wave is neutralized by transfer into a succeeding wave or waves.

Another object is to provide a breakwater from a series of identical modules, each having an elongated unitary body with a low, front end wall facing offshore and a relatively higher, rear end wall facing onshore and defining a single, large upwardly concave, partly cylindrical and partly flat-bottomed wave-energy-absorbing trough therebetween, and a sloping front end surface on the offshore wall for deflecting incoming waves upwardly over the trough and against the back wall causing water to roll or swirl forwardly along the bottom of the trough and erupt at the front wall to impinge upwardly against following, incoming waves, thereby diminishing wave energy by combined water-to-module and water-to-water interaction.

Another object is to provide such a module with horizontal passageways in the higher, rear onshore end wall directing water in jet-like streams forwardly from the onshore side of the breakwater to augment and reinforce the forward rolling and swirling action of water in the trough and increase the energy of water erupting along the back side of the front wall.

Another important feature of the invention is to provide the horizontal passageways with square or rectangular cross-sections which decrease in area in the forward direction to thereby increase the velocity of the jet-like streams through them.

Another important feature of the invention is that the upwardly concave trough is substantially cylindrical in shape along the higher, rear end wall enabling fore-and-aft oscillation of water therein to absorb wave energy under light wave conditions, while enabling forward rolling and swirling action under moderate and severe wave conditions.

Another important feature of the invention is a unitary module having an elongated body with a single, large, upwardly concave wave-energy-absorbing trough, a front end wall with a sloping front end surface to direct incoming waves upwardly over the trough against a curved surface at the rear end of the trough to provide a downwardly- and forwardly-moving and upwardly-erupting, rolling and swirling action of water in the trough impinging upwardly against incoming, overtopping waves, and one or more passageways in the higher, rear wall of the module, at a level above the floor of the trough, to direct water in jet-like streams forwardly through the rear end wall of the module onto the floor of the trough, thereby augmenting the above-described forward rolling and swirling movement of water along it.

Another important feature of the invention is to provide the horizontal passageways with cross-sections which decrease in a forward direction and conversely increase in a rearward direction, thereby progressively increasing the velocity of the jet-like streams when water level on opposite sides of the breakwater enables water to flow forwardly through them, and progressively slowing the velocity through them when water level enables flow in a rearward direction to thereby reduce water energy and deposit water-borne sediment back of the module.

Another important feature of the invention is that the partly cylindrical and partly flat-bottomed shape of the upwardly concave trough enables effective rolling and swirling movement of water in the trough to maximize wave energy absorption of water-to-water interaction with waves overtopping the front wall.

Another important feature of the invention is that the wave energy absorbing trough is defined between front and rear upright walls, the rear wall being substantially higher to intercept waves and spray overtopping the front wall and trough and thereby create, in moderate and severe wave conditions, a rolling movement of water in the trough from the front to the back which erupts along the front wall and impinges on water and spray overtopping the front wall.

Another important feature is to protect a section of shoreline against erosion and reverse the effects of previous erosion by a controlled environment in the form of a lagoon along the shoreline behind a breakwater between a pair of groins, and providing the breakwater with sloping forward surfaces to deflect incoming waves over the breakwater and deposit sediment-containing water in the lagoon, and providing the breakwater and upper passages for returning relatively sediment-free water.

BRIEF DESCRIPTION OF THE DRAWINGS

Other objects and advantages will be apparent from the following description taken in connection with the accompanying drawings in which:

FIG. 4 is a schematic view of one of the modules showing wave energy absorbing action during light wave conditions at low water levels;

FIGS. 5 and 6 are views similar to FIG. 4 during moderate and severe wave conditions, respectively;

FIG. 7 is an alternative application of the invention showing the modules in position at the base of a stone or concrete wall;

FIG. 8 is another alternative application showing the modules in another position to prevent wave action from undercutting the toe of a bluff or bank; and FIG. 9 is an alternative system utilizing multiple breakwaters according to the present invention.

Like parts are referred to by like reference numerals throughout the drawings.

DESCRIPTION OF THE PREFERRED EMBODIMENTS

Figure 1:
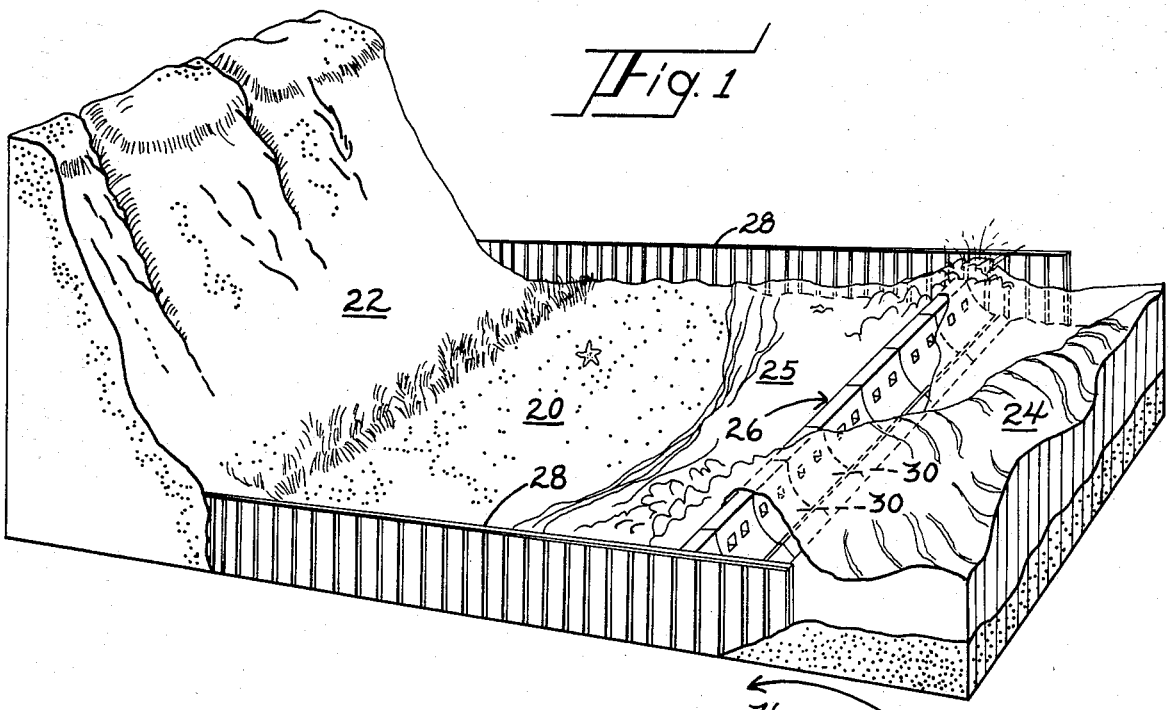
FIG. 1 is a perspective view of a breakwater comprising a plurality of modular units employing the present invention and being placed edgewise in a line parallel to a beach and bluff between a pair of jetties or groins for the purpose of preventing and reversing erosion along the beach and the toe of the bluff.

Referring now to the drawings, one application of the invention is illustrated in FIG. 1 for protecting a section of beach 20 and a bank or bluff 22 from being eroded and undermined by wave action in a body of water 24. A breakwater 26 extends parallel to the shoreline between a pair of groins or jetties 28 extending out from the shoreline. Thus, the breakwater, groins, and shoreline create a lagoon 25 within which the present invention causes wave action to move sediment-containing water and remove substantially sediment-free water.

The breakwater 26 comprises a plurality of similar modules 30 resting on the ground bed below the water. The modules are tied together by a pair of taut cables 32 extending through pairs of pipes 34, 34 embedded in the bases of the respective modules.

Each module is preferably of concrete, poured in one piece, having an elongated body with a single, large upwardly concave, wave-energy-absorbing trough 36 defined between a front wall 38 and a rear wall 40 facing offshore and onshore respectively at opposite ends of a bottom base wall 42 supported on the ground bed beneath the water.

The front wall 38 has an upwardly and rearwardly sloping front end surface 44 and a rear surface 46, the latter defining the front margin of the trough 36. The slope of the front surface 44 is illustrated as approximately 45°, but may be any other angle suitable to deflect incoming waves upwardly so they will overtop the front wall.

The rear wall 40 is substantially higher than the front wall and has a curved cylindrical surface 48 comprising the rear margin of the trough 36. It curves smoothly downwardly and forwardly following a generally cylindrical contour into the floor surface 50 of the trough and extends horizontally forwardly and terminates in a sharp discontinuity 51 at the bottom of the rear surface 46 of the front wall. Thus, the trough comprises curved surface 48 and horizontal, flat surface 50.

The rear wall 40 has horizontal passageway means consisting in the present case of a pair of horizontal passages 52, 52. Each is tapered, Venturi-like, the cross-section reducing in area in the forward (offshore) direction. This causes water velocity to increase when it flows forwardly in the passages 52 from the lagoon 25 and emit in jet-like streams into the trough. The passages 52 are preferably square in cross-section. This provides a sheeting effect in which water coming in from the lagoon flows down in a wide sheet over the curved back wall 48 instead of in a number of separate streams.

Vertical openings 54 extend through the bottom wall and quickly fill up with sediment which hardens or compacts and anchors the module to the ground bed.

A pair of horizontal lifting holes 56 are provided in the front wall. By threading lifting cables through those holes and passageways 52, the modules may readily be lifted and emplaced by helicopter or a land- or water-based crane.

Figure 2:
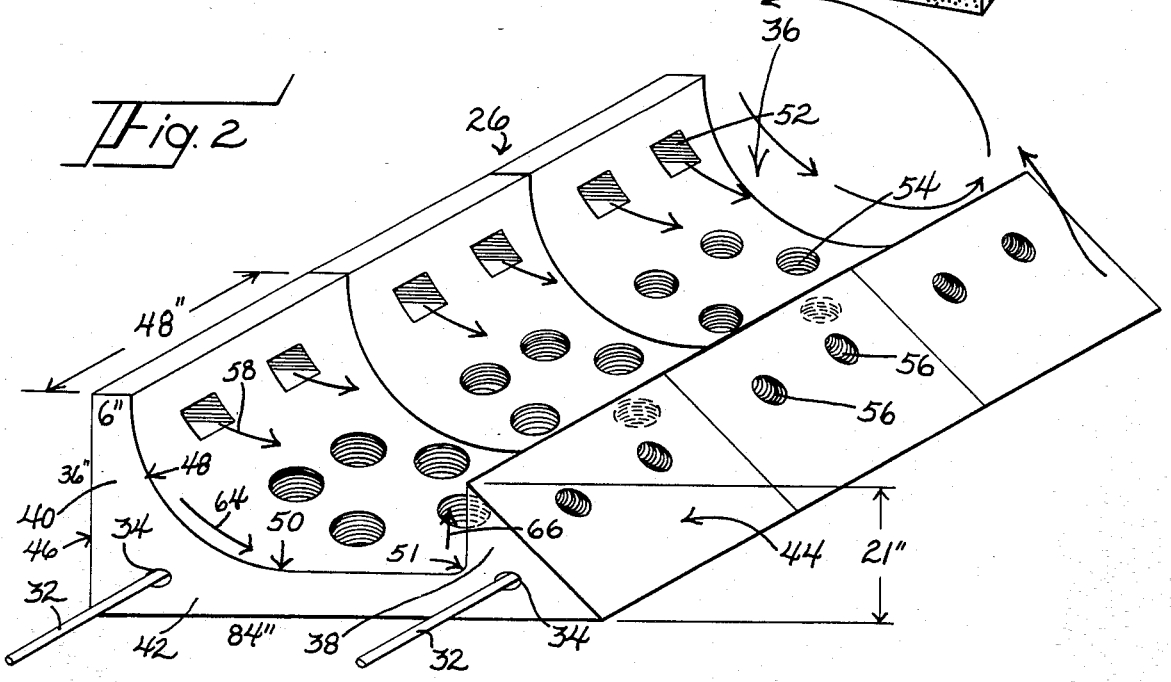
FIG. 2 is an enlarged fragmentary view of FIG. 1 showing three of the modules assembled side-by-side.

The modules may be made in any suitable size and of any suitable heavy material. One such module which has provided excellent results is made of steel-fiber-reinforced concrete, weighing approximately 3,600 lbs. per module, having major external dimensions as shown in FIG. 2.

The sloping front end surface 44 has two functions: first it directs incoming waves upwardly, overtopping the front and back walls and trough to various extents depending on the magnitude of the wave action as shown in FIGS. 4, 5 and 6; and second, it provides a camming surface deflecting incoming ice upwardly over the top of the module in the winter.

Figure 3:
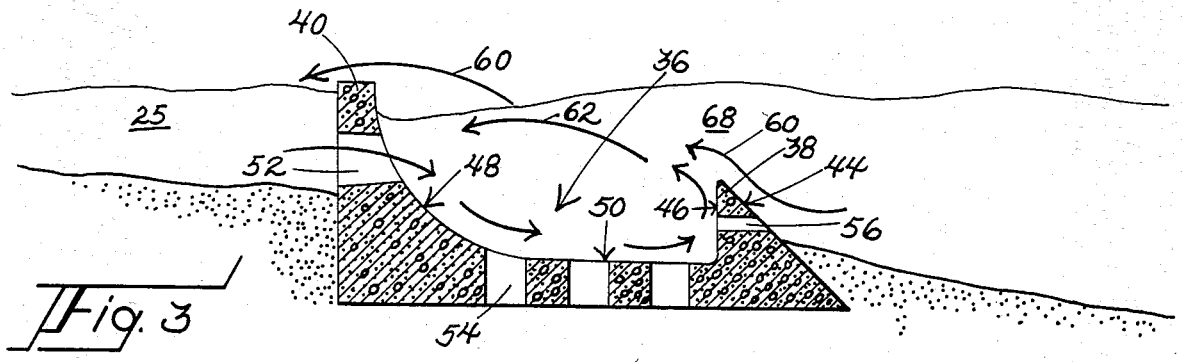
FIG. 3 is a vertical sectional view of one of the modules.

One thing to avoid in these modules is an opening on the offshore side large enough to lodge timbers and logs which can be encased in or engaged by incoming ice and act as levers to displace or up-end the modules. For this reason, the forward ends of the passages 52 are preferably 8" to 10" across, these being small enough to prevent entry of any log large enough and strong enough to function effectively as a lever and tilt the modules out of place. The tapered horizontal passages 52 are an important part of the present invention. In normal use, where the groins 28, 28 are provided at opposite ends of the breakwater 26 to keep littoral currents from carrying away sediments and washing out a trench along the onshore side of the breakwater, waves overtopping the breakwater raise the water level on the onshore side slightly providing a lagoon of some extra depth which drains forwardly through the horizontal passages 52 as the water moves outwardly to equalize the levels. As described, the tapered configurations of the passages cause the water velocity to progressively increase, emitting jet-like streams as shown by arrows 58 in FIGS. 3, 5 and 6. Simultaneously, water and spray from incoming waves are deflected upwardly by the sloping front end surface 44. This water overtops the front wall, the trough, and the rear wall, to various extents as shown by arrows 60 and 62. Some of the water and spray impinges on the curved cylindrical surface 48 at the front of the rear wall and follows it downwardly, joining the jet-like streams 58 which sheet downwardly and forwardly as indicated by arrows 64 in the floor of the trough. At the forward end of the trough, the water abruptly strikes the rear surface 46 of the front wall at the corner 51 and erupts upwardly as shown by arrows 66. This impinges on the incoming waves and spray overtopping the front wall at 68 and removes a substantial part of the energy from the waves which would otherwise be transmitted landward to erode the beach and bluff.

The breakwater 26 comprises individual modules 30 placed in side-by-side abutment in shallow water, two to four feet deep at normal water level, all held in a single line paralleling the shoreline by taut cables 32. The actual lake or sea water level varies of course with high and low water seasons, changes in direction of the prevailing winds, and tides. Therefore, at times, the breakwater may be several feet under the water surface and at other times may protrude above it. Water will flow forwardly or rearwardly in passages 52 depending on the respective average water levels on opposite sides of the breakwater. The great weight of each module, its wide base, and the hydraulically dynamic design involving the water-to-water energy interaction described above provide a stable unit although originally installed by placing them merely on the bed surface beneath the water. This reduces the possibility that the modules will be dislocated by severe wave or ice action. Further, openings 54 extending through the base floor fill with sand and sediment and harden or set to provide additional anchorage and the taut cables 32 provide even greater stability by tying all the modules together into one effective breakwater assembly.

Use and operation is believed to be evident from the foregoing description. Briefly, however, the hydraulically dynamic design functions in the following way. Horizontally moving forces present in the incoming waves are deflected upwardly by the sloping front end surface 44. Energy is dissipated both in changes in direction of water movement and by water-to-concrete and water-to-water impingement. Additional force is directed downward, pressing each module firmly against the lake or sea bottom.

Under light wave conditions in low water levels, there is a fore-and-aft "sloshing" interaction in the trough as shown in FIG. 4 during which time suspended sand and sediment can migrate through the horizontal passages 52 and deposit on the shore side.

Under moderate and severe wave conditions as shown respectively in FIGS. 5 and 6, some of the waves and spray overtopping the front wall impinges on the relatively higher rear wall and swirls downwardly and forwardly in a sort of rolling motion. This is augmented and intensified when water moves outwardly from the lagoon and passes forwardly through the tapered horizontal passages 52. The direction of water flow through the horizontal passages 52 will alternate depending on wave heights and the respective average water levels on opposite sides of the breakwater. When water moves rearwardly through these passages, its energy progressively reduces and releases suspended sand and sediment on the shore side of the rear wall 40.

Referring to FIG. 7, a common cause for failure of a massive stone or concrete wall 74 which is not solidly supported on a rock foundation is scouring resulting from undermining of the bed by wave action. A scour hole 76 is shown by broken lines in FIG. 7. Placing a line of modules 30 against the base of the wall as shown in FIG. 7 will prevent that.

Another serious problem involves the undercutting of the toe of a bluff or bank and subsequent slumpage into the water due to severe storm waves or extreme high water conditions. This can be prevented with the present invention by placing a line of modules 30 along the toe as shown in FIG. 8.

For both the applications shown in FIGS. 7 and 8, modules with the horizontal passages 52 are not necessary although they may be used if they are the only type available.

Refer now to FIG. 9. In situations where wave action and shoreline erosion are especially severe, a second, outer breakwater 70 can be installed from ten to seventy feet outwardly of the primary breakwater 26. Each individual module in the second breakwater may have the same basic configuration as module 30, but should be somewhat lower to enable sharing of wave energy absorption by both breakwaters 26 and 70. Further, the modules in breakwater 70 need not have the horizontal passages 52 and should be installed completely under water with their highest point just below the normal low water level.

The outer breakwater 70 causes sand and sediment deposition in the area between the two breakwaters. This is the result of reduction in wave energy as waves pass over the underwater obstruction formed by the submerged modules in the breakwater 70. Reducing wave energy results in deposition of water-borne materials and the formation of a sand bar 72. This sand bar provides additional protection for the shoreline by facilitating the shoreward transfer and deposition of beach building materials instead of carrying it away from the beach.

Viewed broadly, the present invention comprises means for protecting a section of shoreline against erosion and reversing the effects of previous erosion by providing a lagoon 25 along the shoreline behind the breakwater 26 and between groins 28, 28, and controlling flow into and out of the lagoon by the breakwater so sediment-containing water is directed into the lagoon by incoming wave action against front sloping surface 44, and relatively sediment-free water is returned through the tapered horizontal passages 52.

While the invention has been particularly shown and described with reference to preferred embodiments thereof, it will be understood by those skilled in the art that the foregoing and other changes in form and details may be made therein without departing from the spirit and scope of the invention.

The embodiments of the invention in which an exclusive property or privilege is claimed are defined as follows:

1. A breakwater module adapted to be placed with other like modules in water in a line offshore from a water front for preventing erosion due to wave action and for rebuilding water front property where erosion has already occurred, said module comprising:

an elongated body having a bottom base wall adapted to be supported on the ground bed below the water and having rear and front end walls facing onshore and offshore, respectively, said body having a single, large, upwardly-concave, wave-energy-absorbing trough of partly cylindrical contour the rear and front margins of which comprise cylindrical and flat horizontal surfaces extending along the rear and front end walls respectively;

said front end wall having an upwardly and rearwardly sloping front end surface to break incoming waves into spray and deflect it upwardly over the trough;

said rear end wall being substantially higher than said front wall to intercept waves and spray overtopping the front wall with said cylindrical surface and to re-direct them to cause water to move with a rolling and swirling action downwardly and forwardly along said cylindrical surface and forwardly along said flat horizontal surfact to erupt vertically along said front end wall and impinge in a counter-current manner against waves and spray overtopping the front wall to thereby counteract energy therein;

whereby under light wave conditions, fore-and-aft oscillation of water in the partly cylindrical contour trough absorbs wave energy; and whereby further under moderate and severe wave conditions, the sloping front end surface of the front wall breaks the incoming waves into spray which overtops the front wall, some of which is intercepted by the rear wall and is re-directed downwardly, forwardly and upwardly in the trough providing said rolling and swirling action of water in the trough to impinge against and counteract energy in incoming waves and spray overtopping the front wall.

2. A breakwater module according to claim 1 in which:

said rear wall has horizontal passageway means extending therethrough at a level above the floor of the trough to direct water in jet-like streams forwardly into the trough when the water level at the onshore side of the module is relatively high, thereby augmenting said forward rolling and swirling movement of water along the floor of the trough.

3. A breakwater module according to claim 2 in which the horizontal passageway means has a rectangular cross-section.

4. A breakwater module according to claim 2 in which the cross-section of the horizontal passageway means decreases in a forward direction to progressively increase the forward velocity of said jet-like streams, and to progressively decrease the rearward velocity and precipitate suspended solids from water when it flows in the opposite direction through said passageway means.

5. A breakwater module according to claim 2 in which the juncture between the front end of the floor of the trough and the rear surface of the the front wall is characterized by an abrupt change of angle to suddenly change the direction and reduce energy in water moving forwardly along the floor of the trough and cause water to erupt vertically upwardly along the rear surface of the front wall.

6. A breakwater module according to claim 1 in which apertures are provided through the bottom wall for the accumulation of plugs of sediment to anchor the module to the ground bed and resist displacement of the module.

7. In combination with a sea wall, a breakwater comprising a line of modules according to claim 1 placed along the base of the sea wall to prevent undermining the sea wall by wave action scour.

8. In combination with a bluff or bank along a shore, a breakwater comprising a line of modules according to claim 1 placed along the toe of the bluff or bank to prevent slumping by wave action.

9. In combination with a shoreline to be protected from wave action, a pair of breakwaters spaced apart from one another and from the shoreline, each breakwater comprising a line of modules according to claim 1 to produce a sand bar between the breakwaters.

10. The combination of claim 9 in which the breakwater nearest the shoreline comprises a plurality of modules each having horizontal passageway means extending through the rear wall thereof at a level above the floor of the trough to direct water in jet-like streams forwardly into the trough when the water level on the onshore side thereof is relatively high, thereby augmenting forward rolling and swirling movement of water along the floor of the trough.

11. Means for protecting a section of shoreline against erosion and reversing the effects of previous erosion comprising:

means for enclosing a lagoon along said section of shoreline including an elongated breakwater extending parallel to the shoreline and a pair of groins extending from the ends of the breakwater to the shoreline;

said breakwater comprising a bottom base wall resting on the ground bed below the water, and spaced-apart front and rear upright walls along offshore and onshore edges of said bottom base wall;

a single, large, upwardly-concave, wave-energy-absorbing trough of partly cylindrical contour between said upright walls;

said front wall having an upwardly and rearwardly sloping front end surface to break incoming waves into spray and deflect it upwardly and rearwardly with suspended sediment into said lagoon behind the breakwater; and horizontal passageway means in an upper part of the rear upright wall enabling return flow of substantially sediment-free water from the lagoon to the main body of water offshore from the breakwater.

12. Means for protecting a section of shoreline according to claim 1 in which the rear upright wall is substantially higher than said front upright wall to intercept incoming waves overtopping the front upright wall and deflect them downwardly, forwardly and upwardly in a rolling and swirling action in said trough to impinge against following incoming waves overtopping said front upright wall.

* * * * *